US008746111B2

(12) United States Patent
Eglin et al.

(10) Patent No.: US 8,746,111 B2
(45) Date of Patent: Jun. 10, 2014

(54) FLOATING WRENCH ASSEMBLY FOR DRILL RIG

(75) Inventors: John J. Eglin, Polk, OH (US); Neil M. Baker, Gambler, OH (US)

(73) Assignee: Astec Industries, Inc., Chattanooga, TN (US)

( * ) Notice: Subject to any disclaimer, the term of this patent is extended or adjusted under 35 U.S.C. 154(b) by 523 days.

(21) Appl. No.: 13/066,490

(22) Filed: Apr. 15, 2011

(65) Prior Publication Data

US 2011/0252926 A1 Oct. 20, 2011

Related U.S. Application Data

(60) Provisional application No. 61/342,504, filed on Apr. 15, 2010.

(51) Int. Cl.
*B25B 17/00* (2006.01)

(52) U.S. Cl.
USPC ..... 81/57.34; 81/27; 81/35; 81/54

(58) Field of Classification Search
USPC ..... 81/54, 57.34, 27.35
See application file for complete search history.

(56) References Cited

U.S. PATENT DOCUMENTS

| | | | | |
|---|---|---|---|---|
| 2,669,981 | A | 2/1954 | Leach | |
| 3,780,815 | A * | 12/1973 | Barron et al. | 173/195 |
| 4,921,386 | A | 5/1990 | McArthur | |
| 5,388,651 | A | 2/1995 | Berry | |
| 6,047,775 | A | 4/2000 | Mock | |
| 6,814,149 | B2 | 11/2004 | Liess et al. | |
| 6,938,519 | B2 | 9/2005 | Boyd et al. | |
| 7,090,254 | B1 | 8/2006 | Pietras et al. | |
| 7,117,938 | B2 | 10/2006 | Hamilton et al. | |
| 7,413,398 | B2 | 8/2008 | Bangert et al. | |
| 7,665,514 | B2 | 2/2010 | Patterson | |
| 7,921,750 | B2 * | 4/2011 | Pietras | 81/57.16 |
| 2004/0035573 | A1 | 2/2004 | Pietras | |
| 2007/0023183 | A1 | 2/2007 | Lesko | |
| 2007/0114069 | A1 | 5/2007 | Hooper et al. | |
| 2008/0307932 | A1 | 12/2008 | Lauzon et al. | |
| 2009/0056930 | A1 | 3/2009 | Angelle et al. | |
| 2009/0255662 | A1 | 10/2009 | Ge | |
| 2010/0200258 | A1 | 8/2010 | Tarnowski et al. | |

OTHER PUBLICATIONS

International Preliminary Report on Patentability (including Written Opinion of the International Searching Authority) with respect to PCT/US2011/000687.

* cited by examiner

*Primary Examiner* — Lee D Wilson
*Assistant Examiner* — Shantese McDonald
(74) *Attorney, Agent, or Firm* — Chambliss, Bahner & Stophel, P.C.

(57) ABSTRACT

A wrench assembly is mounted on a drill rig so as to have some freedom of movement in three axes. The wrench assembly includes a wrench subassembly having an upper wrench and a lower wrench. Both the upper wrench and the lower wrench are provided with jaw assemblies that are adapted to grip a pipe section or to release it. One of the upper wrench and lower wrench is pivotally moveable with respect to the other to apply a twisting force to a pipe section gripped by one of the upper and lower wrenches with respect to an adjacent pipe section gripped by the other of the upper and lower wrenches. The wrench assembly also includes a generally planar support table. The wrench subassembly is attached to the support table in such a manner as to allow the wrench subassembly to pivot about an axis that is perpendicular to the plane of the support table, and in such a manner as to allow the wrench subassembly to tilt with respect to the plane of the support table.

18 Claims, 7 Drawing Sheets

FLOATING WRENCH ASSEMBLY FOR DRILL RIG

CROSS-REFERENCE TO RELATED APPLICATION

This application claims the benefit of U.S. Provisional Patent Application No. 61/342,504, which was filed on Apr. 15, 2010.

FIELD OF THE INVENTION

The present invention relates generally to drilling rigs that employ a drill string comprised of a plurality of drill pipes that are joined together in threaded engagement. More particularly, the invention comprises a wrench assembly that is used to tighten or loosen the threaded connection between a pair of adjacent drill pipes.

BACKGROUND OF THE INVENTION

Drilling rigs employ hydraulically actuated wrenches to tighten and loosen the threaded connections between drill pipes. These wrenches comprise two pairs of opposed jaws, one for the male-threaded pipe and the other for the female-threaded pipe of the adjacent components of the drill string. Each wrench is adapted to clamp around a pipe section, one above and the other below the threaded connection. At least one clamping component of the wrench assembly will pivot with respect to another clamping component so as to twist one of the pipe sections with respect to the other. There are two common problems that are not adequately addressed by conventional wrench assemblies. The first is misalignment of the drill pipe string with the wrench assembly due to one or more pipe sections being bent or misaligned. This condition interferes with the ability of the wrench assembly to clamp effectively onto the pipe sections and therefore jeopardizes the ability of the wrench to tighten or loosen the joint between adjacent pipe sections. The other problem arises from inadvertent axial movement (with respect to the drill string) of the drill rig carriage (on which the wrench assembly is mounted) while the clamping components of the wrench assembly are clamped onto the drill pipes. Such axial movement while the pipe sections are clamped can damage the drill pipes, the wrench assembly and other components of the drill rig.

It is known to provide wrench assemblies that are adapted for use with drill pipes of various diameters. Such assemblies are described in U.S. Patent Application Publication No. 2009/0255662 and U.S. Pat. No. 7,665,514. It is also known to provide wrench assemblies that are adapted for use with drill pipes having wall thicknesses that have become tapered through wear. Such assemblies are described in U.S. Pat. No. 6,938,519 and U.S. Pat. No. 6,814,149. It is also known to provide pipe guide assemblies that are adapted to guide or position a drill pipe for engagement by a pipe gripping apparatus. Such assemblies are described in U.S. Patent Application Publication No. 2009/0056930 and U.S. Pat. No. 7,090,254. Finally, U.S. Patent Publication No. 2010/0200258 describes a wrench assembly that is adapted to automatically disengage from the pipe sections if the pipe is raised or lifted, such as for example, if the operator inadvertently withdraws the pipe from the drill hole without first disengaging the wrench assembly.

It would be desirable, however, if a wrench assembly could be provided on a drill rig so as to have some freedom of movement in three axes. A preferred embodiment of such a wrench assembly would be self-orienting when clamped onto misaligned pipe sections, and it would also deflect without damage when an axial force is inadvertently applied while the wrenches of the assembly are clamped onto adjacent pipe sections of a drill string.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

The use of any and all examples or exemplary language (e.g., "such as") herein is intended merely to better illuminate the invention and not to place a limitation on the scope of the invention. Nothing in the specification should be construed as indicating any element as essential to the practice of the invention unless so stated with specificity.

Various terms are specifically defined herein. These terms are to be given their broadest possible construction consistent with such definitions, as follows:

The terms "lower" and "below" and similar terms of relative position refer to the part of the wrench assembly nearest the ground on which the drill rig is placed when drilling.

The terms "upper" and "above" and similar terms or relative position refer to the part of the wrench assembly opposite the lower part.

The term "linear actuator" refers to an electric, hydraulic or electro-hydraulic device that generates force which is directed in a straight line. One common example of a linear actuator is a fluid actuator which includes a cylinder, a piston within the cylinder, and a rod attached to the piston. By increasing the pressure within the cylinder on one side of the piston (over that on the opposite side of the piston), the rod will extend from the cylinder or retract into the cylinder.

The terms "pipe section", "drill pipe section" and similar terms refer to a hollow tubular component that is provided with male threads on one end and corresponding female threads on the other, and is intended to be connected by threaded engagement, or is connected by threaded engagement, to an adjacent pipe section.

The terms "drill pipe", "drill string" and similar terms refer to a plurality of pipe sections that are joined together by threaded engagement, with a drill bit or other boring component at the lower end thereof.

The term "adjacent pipe sections" and similar terms refer to a pair of pipe sections that are joined together by threaded engagement to form a part of a drill string, or are located or placed with respect to each other so as to be joined together in such manner, or have been disengaged from each other.

SUMMARY OF THE INVENTION

The invention comprises a wrench assembly that is mounted on a drill rig so as to have some freedom of movement in three axes. This allows the wrench assembly to be self-orienting when clamped onto misaligned pipe sections, and it also allows it to deflect without damage when an axial force is inadvertently applied while the wrenches of the assembly are clamped onto adjacent pipe sections of a drill string. Such wrench assembly comprises a wrench subassembly which includes an upper wrench and a lower wrench. Both the upper wrench and the lower wrench are provided with jaw assemblies that are adapted to grip a pipe section or to release it. One of the upper wrench and lower wrench is pivotally moveable with respect to the other to apply a twisting force to a pipe section gripped by one of the upper and lower wrenches with respect to an adjacent pipe section gripped by the other of the upper and lower wrenches, and means are provided for pivotally moving one of the upper wrench and the lower wrench with respect to the other. The wrench assembly also includes a generally planar support table, and means for attaching the wrench subassembly to the support table. One such means is adapted to allow the wrench subassembly to pivot about an axis that is perpendicular to the plane of the support table, and another such means is adapted to allow the wrench subassembly to tilt with respect to the plane of the support table.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which.

DESCRIPTION OF THE PREFERRED EMBODIMENTS OF THE INVENTION

Figure 1:
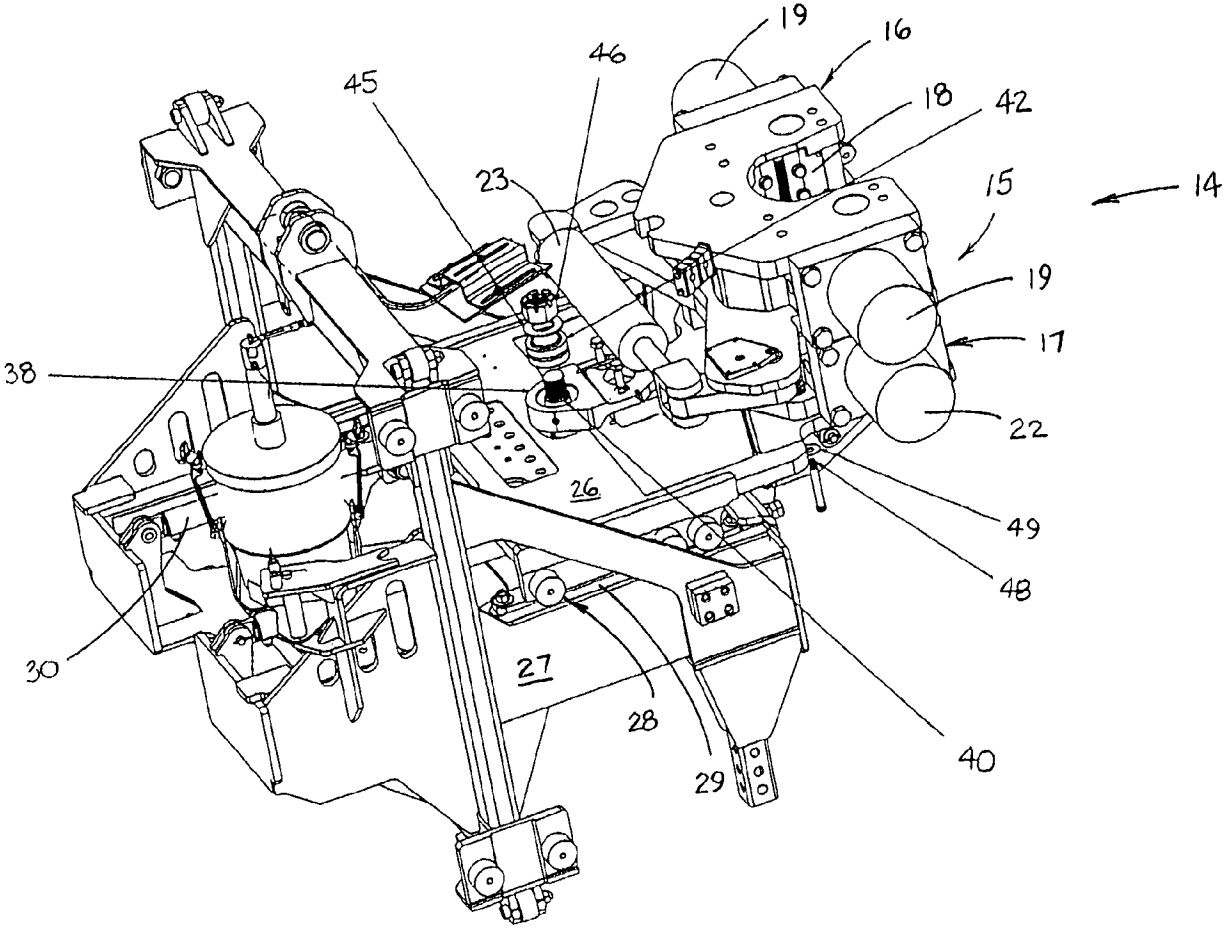
FIG. 1 is a perspective view of a first embodiment of a wrench assembly according to the invention.

Referring now to the drawings, a first embodiment of the invention is illustrated in FIGS. 1-10. As shown therein, wrench assembly 14 includes wrench subassembly 15 comprised of upper wrench 16 and lower wrench 17. Upper wrench 16 includes jaw assembly 18 having oppositely disposed linear actuators 19 that may be operated to close the jaws of the assembly to grip a pipe section or to open the jaws to release it. Lower wrench 17 includes a similar jaw assembly having linear actuators 22 that may be operated to close the jaws of the assembly to grip a pipe section or to open the jaws to release it.

Figure 2:
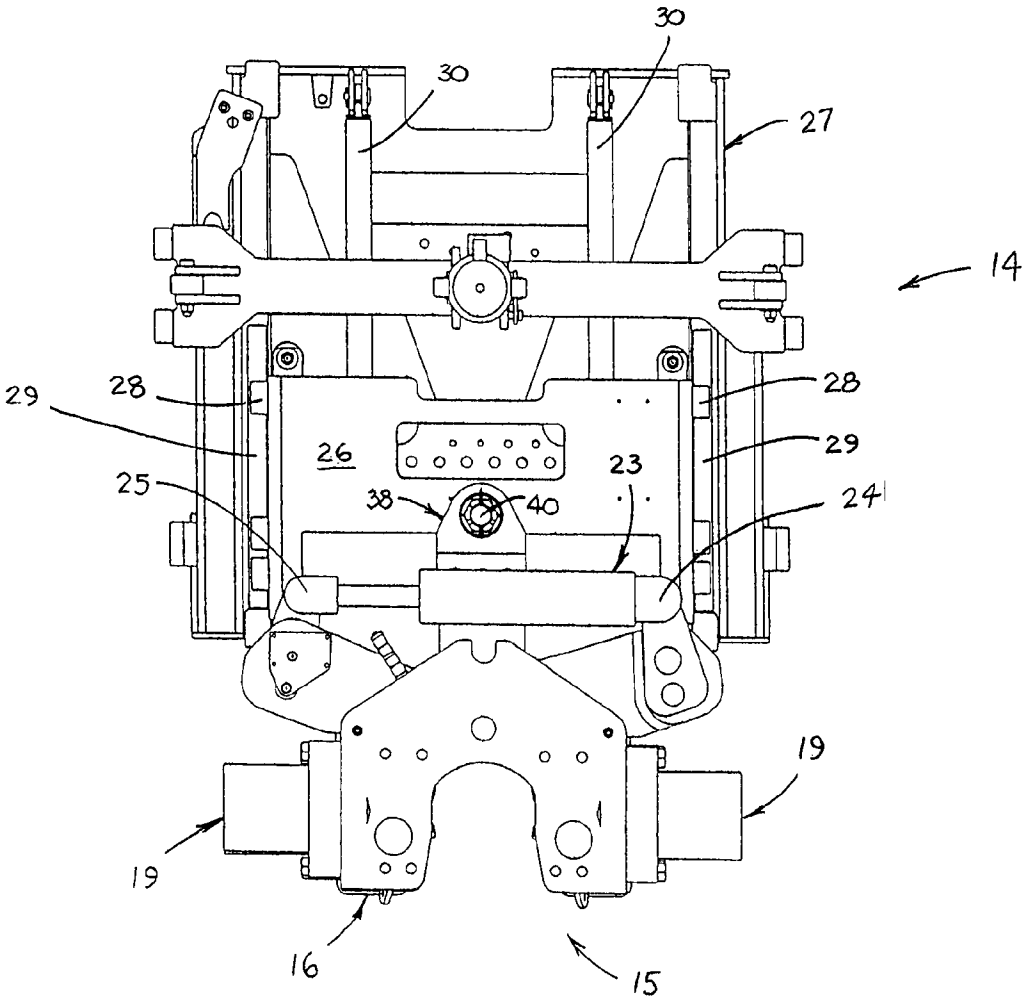
FIG. 2 is a top view of the assembly of FIG. 1.
Figure 3:
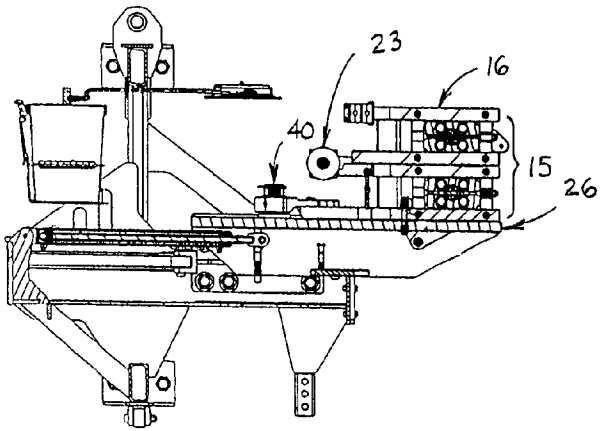
FIG. 3 is a side view and partial sectional view of the assembly of FIGS. 1 and 2.

The upper wrench is pivotally moveable with respect to the lower wrench about an axis that is perpendicular to the plane of FIG. 2, so that when the lower wrench grips a pipe section and the upper wrench grips an adjacent pipe section, the upper wrench can be pivoted to apply a twisting force to the pipe section gripped by the upper wrench with respect to the adjacent pipe section gripped by the lower wrench. In the alternative, the lower wrench may be moveable with respect to the upper wrench, so that when the upper wrench grips a pipe section and the lower wrench grips an adjacent pipe section, the lower wrench can be pivoted to apply a twisting force to the pipe section gripped by the lower wrench with respect to the adjacent pipe section gripped by the upper wrench.

Means are provided to pivotally move the upper wrench with respect to the lower wrench. As best shown in FIG. 2, such means comprise linear actuator 23, which has a base end 24 that is attached to lower wrench 17 and a rod end 25 that is attached to upper wrench 16. In the alternative (although not shown in the drawings), the rod end of a linear actuator could be attached to the lower wrench and the base end to the upper wrench. By actuating linear actuator 23 in the embodiment shown in FIGS. 1-10, the upper wrench can be pivoted with respect to the lower wrench to apply the twisting force described above to loosen or tighten the threaded connection between adjacent pipe sections.

As described in more detail hereinafter, means are provided for attaching wrench subassembly 15 to generally planar support table 26 in such a way that it may pivot, preferably both to the left and to the right (as viewed in FIG. 2), about an axis that is perpendicular to the plane of the support table to properly orient the jaws of the wrenches when attempting to clamp onto misaligned pipe sections. In addition, means are provided for attaching wrench subassembly 15 to generally planar support table 26 in such a way that it may tilt with respect to the plane of the support table, to compensate for an inadvertent axial force that is applied to the drill rig or to the wrench assembly while the wrenches are clamped onto adjacent pipe sections of a drill string. Preferably, such tilting means allow the wrench subassembly to tilt through an angle of at least about 6° with respect to the plane of the support table. More preferably, such tilting means allows the wrench subassembly to tilt upwardly on the left side (as viewed from the perspective of FIG. 2), upwardly on the right side, or upwardly by lifting both sides through the same tilt angle. It is also preferred that support table 26 be moveable with respect to underlying frame 27. As best shown in FIGS. 1 and 2, support table 26 is provided with a plurality of wheels or rollers 28 that are adapted to roll along left and right roller paths 29 of frame 27. A pair of linear actuators 30 are mounted between frame 27 and support table 26 to move the support table with respect to the frame. Thus, the support table may be moved laterally, by actuating linear actuators 30, to center the wrench subassembly on the theoretical drill string axis. An open center valve (not shown) in fluid communication with linear actuators 30 allows for relatively free motion about that axis in the event that the adjacent pipe sections to be engaged by the wrench assembly are not aligned with the theoretical axis. Furthermore, the invention allows support table 26 to pivot about an axis that is perpendicular to the plane of the support table to properly orient the jaws of the wrenches when attempting to clamp onto misaligned pipe sections, and to tilt with respect to the plane of the support table to compensate for an inadvertent axial force that is applied to the drill rig or to the wrench assembly while the wrenches are clamped onto adjacent pipe sections of a drill string.

Figure 8:
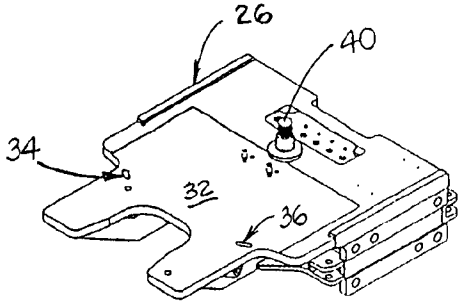
FIG. 8 is a perspective view of the support plate and support table of FIGS. 6 and 7.
Figure 7:
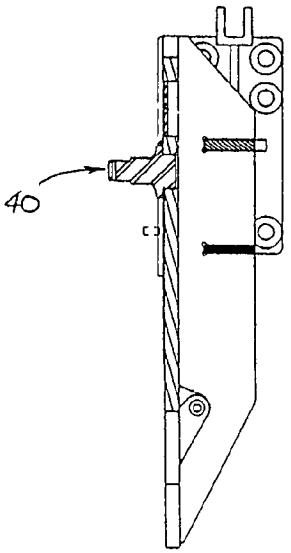
FIG. 7 is a sectional view of the support plate and support table of FIG. 6, taken through the line 7-7 of FIG. 6.
Figure 6:
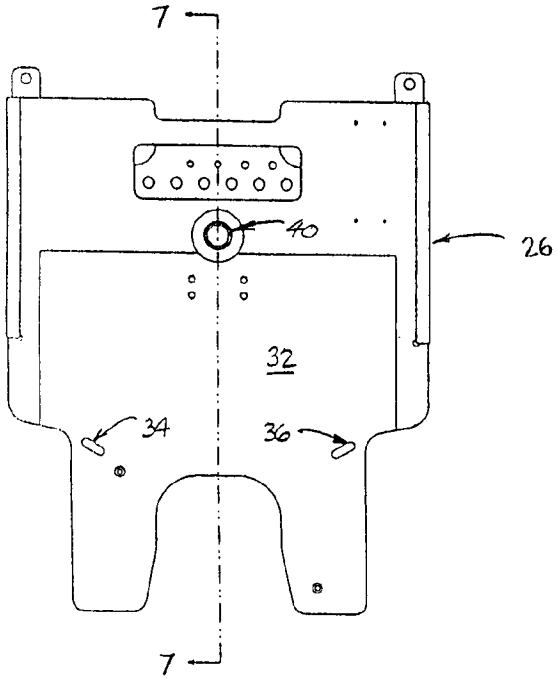
FIG. 6 is a top view of the support plate and support table on which the wrench subassembly is mounted.

In the embodiment of the illustrated in FIGS. 1-10, generally planar support table 26 includes support plate 32 that is provided with a first angled slot 34 and a second angled slot 36 (shown in FIGS. 6 and 8). Wrench subassembly 15 includes bearing plate 38, and support table 26 includes pivot shaft 40. Spherical bearing 42 is placed over pivot shaft 40 and is adapted to be received in bearing hole 44 (shown in FIG. 4) in bearing plate 38. Washer 45 is placed atop the spherical bearing and nut 46 is threaded onto pivot shaft 40 to secure the wrench subassembly thereon.

Figure 10:
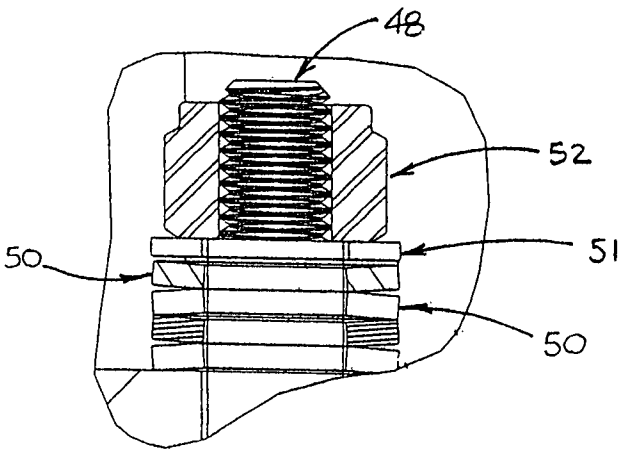
FIG. 10 is a detail view of the shoulder bolt nut and washer assembly that allows for pivoting and tilting motion of the wrench subassembly with respect to the support table.
Figure 9:
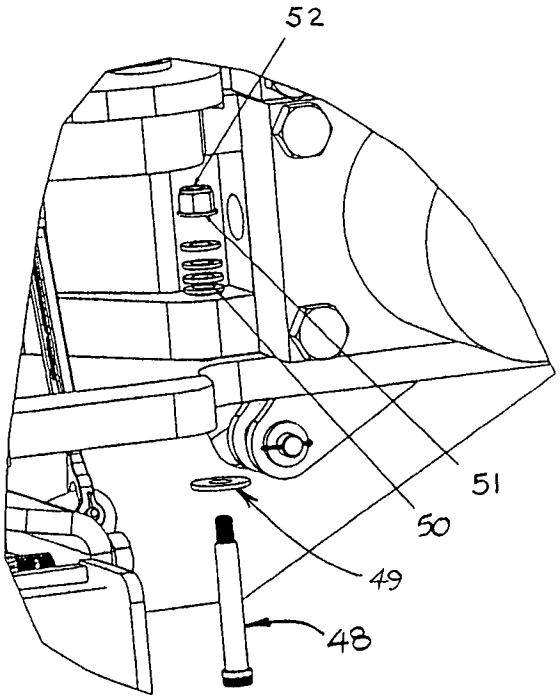
FIG. 9 is an exploded view of the shoulder bolt nut and washer assembly that allows for pivoting and tilting motion of the wrench subassembly with respect to the support table.

A first shoulder bolt and a second shoulder bolt (only one of which is shown in the drawings) are provided for placement through the angled slots. Thus, as shown in FIGS. 1, 9 and 10, first shoulder bolt 48 is placed through slot 34 in support plate 32. Preferably, a flat washer such as washer 49 is placed over the shoulder bolt before it is inserted through the appropriate slot. Mounted atop the lower wrench on the shoulder bolts are a plurality of tilt washers, such as spring washers or Belleville washers 50, a flat washer 51 and a securing nut 52, shown in FIGS. 9 and 10. The illustrated combination of angled slots 34 and 36 and the shoulder bolts comprise a pivoting stop mechanism that allows the wrench subassembly to pivot to the left or right about an axis that is generally perpendicular to the plane of the support table and through the center of spherical bearing 42. In the embodiment of the invention that includes the angled slots and shoulder bolts, the wrench subassembly may pivot by at least about one inch from the center of slots 34 and 36 to compensate for a misaligned drill string or misaligned pipe sections. The tilt washers are stacked in a non-parallel fashion or otherwise arranged so that the combination of the spherical bearing, shoulder bolts and tilt washers allow the wrench subassembly to tilt through a preferred angle of at least about 6°, as measured from the plane of the support table, to compensate for inadvertent axial forces. Preferably, the wrench subassembly is adapted to tilt upwardly on either the left or the right side, or on both sides, with respect to the plane of the support table.

Figure 11:
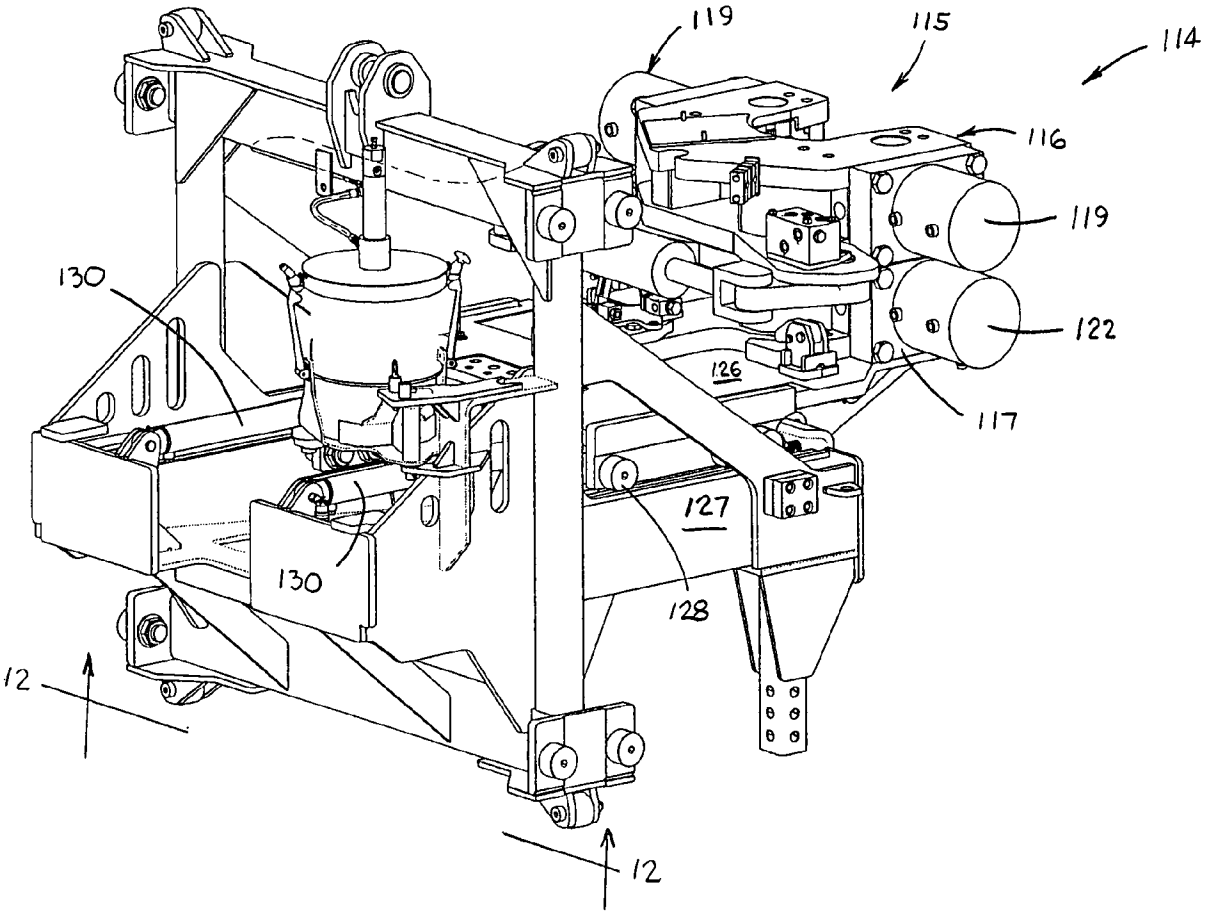
FIG. 11 is a perspective view of a second embodiment of a wrench assembly according to the invention.
Figure 13:
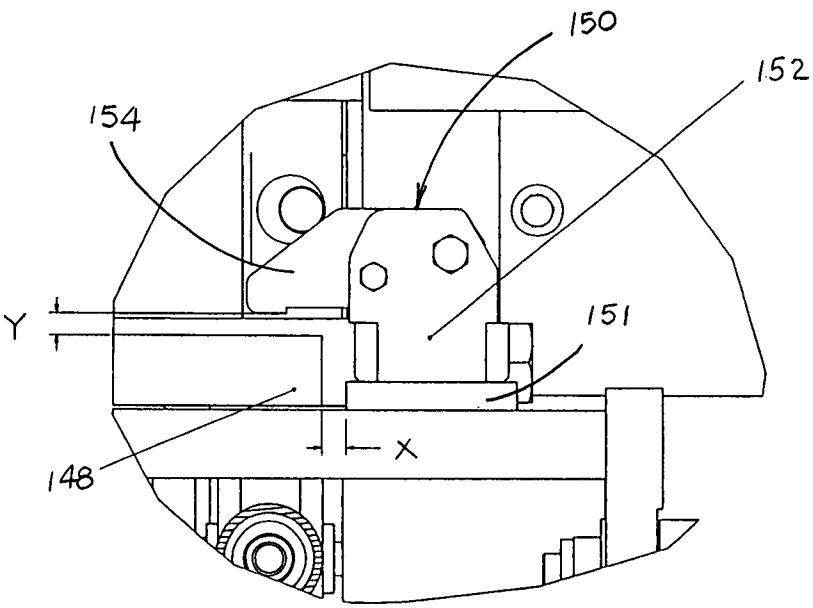
FIG. 13 is a detail view of the pivoting stop mechanism of the embodiment of FIGS. 11 and 12.
Figure 12:
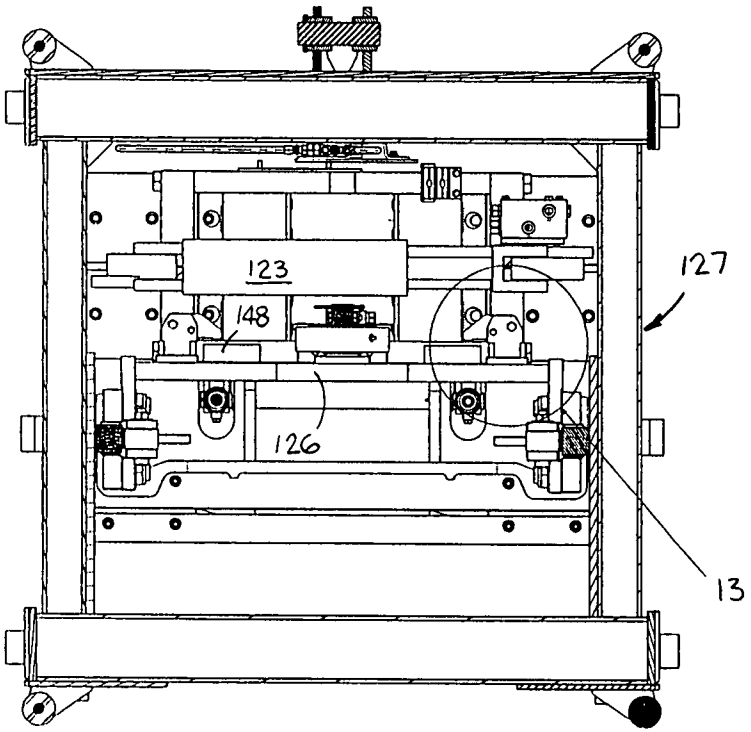
FIG. 12 is a sectional view of the embodiment of FIG. 11, taken along the line 12-12 of FIG. 11.

An alternative embodiment of the invention is illustrated in FIGS. 11-13. As shown therein, wrench assembly 114 includes wrench subassembly 115 comprised of upper wrench 116 and lower wrench 117. Upper wrench 116 includes a jaw assembly that is essentially identical to jaw assembly 18 of upper wrench 16 of wrench assembly 14. The jaw assembly of upper wrench 116 includes oppositely disposed linear actuators 119 that may be operated to close the jaws of the assembly to grip a pipe section or to open the jaws to release it. Lower wrench 117 includes a similar jaw assembly having linear actuators 122 that may be operated to close the jaws of the assembly to grip a pipe section or to open the jaws to release it.

The upper wrench is pivotally moveable with respect to the lower wrench, so that when the lower wrench grips a pipe section and the upper wrench grips an adjacent pipe section, the upper wrench can be pivoted to apply a twisting force to the pipe section gripped by the upper wrench with respect to the adjacent pipe section gripped by the lower wrench. In the alternative, the lower wrench may be moveable with respect to the upper wrench, so that when the upper wrench grips a pipe section and the lower wrench grips an adjacent pipe section, the lower wrench can be pivoted to apply a twisting force to the pipe section gripped by the lower wrench with respect to the adjacent pipe section gripped by the upper wrench.

Means are provided to pivotally move the upper wrench with respect to the lower wrench. As best shown in FIG. 12, such means comprise linear actuator 123, which has a base end that is attached to the lower wrench and a rod end that is attached to the upper wrench. In the alternative (although not shown in the drawings), the rod end of a linear actuator could be attached to the lower wrench and the base end to the upper wrench. By actuating linear actuator 123 in the embodiment of FIGS. 11-13, the upper wrench can be pivoted with respect to the lower wrench to apply the twisting force described above to loosen or tighten the threaded connection between adjacent pipe sections.

Means are also provided for attaching wrench subassembly 115 to generally planar support table 126 in such a way that it may tilt with respect to the plane of the support table, to compensate for an inadvertent axial force that is applied to the drill rig or to the wrench assembly while the wrenches are clamped onto adjacent pipe sections of a drill string. Preferably, such tilting means allow the wrench subassembly to tilt through an angle of at least about 6° with respect to the plane of the support table. More preferably, such tilting means allows the wrench subassembly to tilt upwardly on the left side, upwardly on the right side, or upwardly by lifting both sides through the same tilt angle. It is also preferred that support table 126 be moveable with respect to underlying frame 127. As best shown in FIG. 11, support table 126 is provided with a plurality of wheels or rollers 128 that are adapted to roll along left and right roller paths of frame 127. A pair of linear actuators 130 are mounted between frame 127 and support table 126 to move the support table with respect to the frame. Thus, the support table may be moved laterally, by actuating linear actuators 130, to center the wrench subassembly on the theoretical drill string axis. An open center valve (not shown) in fluid communication with linear actuators 130 allows for relatively free motion about that axis in the event that the adjacent pipe sections to be engaged by the wrench assembly are not aligned with the theoretical axis. Furthermore, the invention allows support table 126 to pivot about an axis that is perpendicular to the plane of the support table to properly orient the jaws of the wrenches when attempting to clamp onto misaligned pipe sections, and to tilt with respect to the plane of the support table to compensate for an inadvertent axial force that is applied to the drill rig or to the wrench assembly while the wrenches are clamped onto adjacent pipe sections of a drill string.

Figure 4:
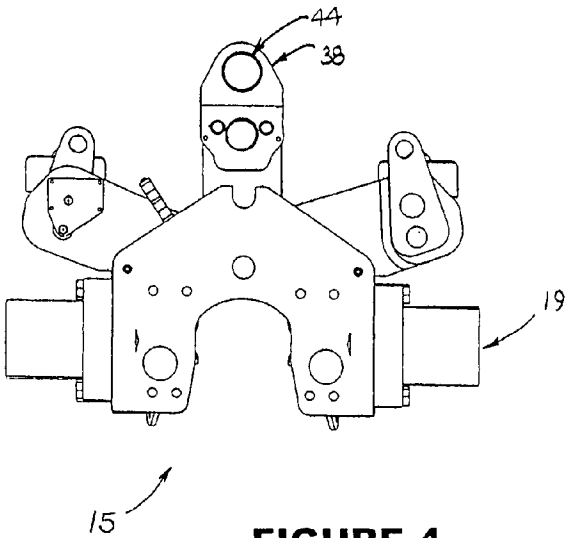
FIG. 4 is a top view of the wrench subassembly.
Figure 5:
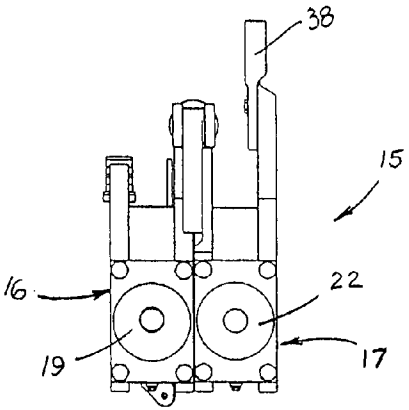
FIG. 5 is a side view of the wrench subassembly of FIG. 4.

Wrench subassembly 115 includes a bearing plate (not shown, but essentially identical to bearing plate 38 of wrench subassembly 15), and support table 126 includes a pivot shaft (also not shown, but essentially identical to pivot shaft 40 of wrench assembly 14). A spherical bearing (not shown but essentially identical to spherical bearing 42 of wrench assembly 14) is placed over the pivot shaft and is adapted to be received in a bearing hole (also not shown, but essentially identical to bearing hole 44 that is shown in FIG. 4) in the bearing plate. A washer is placed atop the spherical bearing and a nut is threaded onto the pivot shaft to secure the wrench subassembly thereon.

A pivoting stop mechanism for this embodiment of the invention comprises a pair of weldments 148 and associated stop brackets 150. Weldments 148 are attached to lower wrench 117 and stop brackets 150 are attached to support table 126. The stop brackets include bracket base 151, bracket upright 152 and bracket arm 154. As shown in FIG. 13, each bracket arm 154 is arranged to clear its associated weldment 148 by distance "Y", thus allowing for tilting of the wrench subassembly with respect to support table 126. Distance "X" indicates the clearance between bracket base 151 and weldment 148 when the wrench subassembly is centered with respect to support table 126. Distance "X" on either side of the wrench subassembly allows for pivotal movement of the wrench subassembly through a limited range before either of weldments 148 abuts its associated bracket base 151. The illustrated combination of weldments 148 and stop brackets 150 comprise a pivoting stop mechanism that allows the wrench subassembly to pivot to the left or right about an axis that is generally perpendicular to the plane of the support table and through the center of the spherical bearing. Such pivotal motion allows the wrench assembly to compensate for a misaligned drill string or misaligned pipe sections.

Although this description contains many specifics, these should not be construed as limiting the scope of the invention, but as merely providing illustrations of some of the presently preferred embodiments thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A wrench assembly comprising:

(a) a wrench subassembly comprising:

(i) an upper wrench having a jaw assembly that is adapted to grip a pipe section or to release it;

(ii) a lower wrench having a jaw assembly that is adapted to grip a pipe section or to release it;

wherein one of the upper wrench and the lower wrench is pivotally moveable with respect to the other to apply a twisting force to a pipe section gripped by one of the upper and lower wrenches with respect to an adjacent pipe section gripped by the other of the upper and lower wrenches;

(b) means for pivotally moving one of the upper wrench and the lower wrench with respect to the other;

(c) a generally planar support table;

(d) means for attaching the wrench subassembly to the support table, said means being adapted to allow the wrench subassembly to pivot about an axis that is perpendicular to the plane of the support table;

(e) means for attaching the wrench subassembly to the support table, said means being adapted to allow the wrench subassembly to tilt with respect to the plane of the support table:

(f) which includes a frame;

wherein the support table is adapted to move linearly with respect to the frame.

2. The wrench assembly of claim 1 wherein the means for pivotally moving one of the upper wrench and the lower wrench with respect to the other comprises a linear actuator having a base end that is attached to one of the upper wrench and the lower wrench and a rod end that is attached to the other of the upper wrench and the lower wrench.

3. The wrench assembly of claim 1 wherein the means for attaching the wrench subassembly to the support table is adapted to allow the wrench subassembly to tilt through an angle of at least about 6° with respect to the plane of the support table.

4. The wrench assembly of claim 1 wherein the means for attaching the wrench subassembly to the support table is adapted to allow the wrench subassembly to tilt upwardly on the left or the right side or on both sides with respect to the plane of the support table.

5. The wrench assembly of claim 1:

(a) wherein the frame includes left and right roller paths;

(b) wherein the support table includes a plurality of rollers that are adapted to roll along the left and right roller paths;

(c) which includes a linear actuator that is adapted to move the support table with respect to the frame.

6. The wrench assembly of claim 1 wherein the means for attaching the wrench subassembly to the support table is adapted to allow the wrench subassembly to pivot, to the left and the right, about an axis that is perpendicular to the plane of the support table.

7. The wrench assembly of claim 6 which includes a pivoting stop mechanism for limiting the pivotal movement of the wrench subassembly on the support table.

8. The wrench assembly of claim 7 wherein:

(a) the support table includes a support plate;

(b) the pivoting stop mechanism comprises:

(i) a first angled slot and a second angled slot that are provided in the support plate;

(ii) a first shoulder bolt that is placed through the first angled slot;

(iii) a second shoulder bolt that is placed through the second angled slot.

9. The wrench assembly of claim 8 wherein a plurality of tilt washers selected from the group consisting of spring washers and Belleville washers are mounted atop the lower wrench on the first shoulder bolt, and a plurality of tilt washers selected from the group consisting of spring washers and Belleville washers are mounted atop the lower wrench on the second shoulder bolt.

10. The wrench assembly of claim 7 wherein the pivoting stop mechanism comprises a stop bracket that is mounted on the support table.

11. The wrench assembly of claim 7 wherein the pivoting stop mechanism comprises:

(a) a weldment that is attached to the lower wrench;

(b) a stop bracket including a bracket base, bracket upright and bracket arm;

wherein the weldment and stop bracket are configured and arranged so that:

(c) the bracket arm is spaced from the weldment by a distance sufficient to allow for tilting of the wrench subassembly with respect to the support table; and (d) the bracket base is spaced from the weldment by a distance sufficient to allow for pivotal movement of the wrench subassembly on the support table.

12. A wrench assembly comprising:

(a) a wrench subassembly comprising:

(i) a lower wrench having a jaw assembly that is adapted to grip a pipe section or to release it;

(ii) an upper wrench having a jaw assembly that is adapted to grip a pipe section or to release it, said upper wrench being pivotally moveable with respect to the lower wrench to apply a twisting force to a pipe section gripped by the upper wrench with respect to an adjacent pipe section gripped by the lower wrench;

(b) means for pivotally moving the upper wrench with respect to the lower wrench;

(c) a generally planar support table;

(d) means for attaching the wrench subassembly to the support table, said means being adapted to allow the wrench subassembly to pivot, to the left and the right, about an axis that is perpendicular to the plane of the support table;

(e) means for attaching the wrench subassembly to the support table, said means being adapted to allow the wrench subassembly to tilt with respect to the plane of the support table;

(f) which includes a frame;

wherein the support table is adapted to move linearly with respect to the frame.

13. The wrench assembly of claim 12, wherein the means for pivotally moving the upper wrench with respect to the lower wrench comprises a linear actuator having a base end that is attached to the lower wrench and a rod end that is attached to the upper wrench.

14. The wrench assembly of claim 12 wherein the means for attaching the wrench subassembly to the support table is adapted to allow the wrench subassembly to tilt upwardly on either the left or the right side, or on both sides, through an angle of at least about 6° with respect to the plane of the support table.

15. The wrench assembly of claim 12 wherein:

(a) the support table includes a threaded pivot shaft;

(b) the wrench subassembly includes a bearing plate having a bearing hole;

(c) a spherical bearing is provided, said spherical bearing being placed over the pivot shaft and received in the bearing hole of the bearing plate.

16. The wrench assembly of claim 12:

(a) wherein the frame includes left and right roller paths;

(b) wherein the support table includes a plurality of rollers that are adapted to roll along the left and right roller paths;

(c) which includes a linear actuator that is adapted to move the support table with respect to the frame.

17. The wrench assembly of claim 12 which includes a pivoting stop mechanism for limiting the pivotal movement of the wrench subassembly on the support table.

18. A wrench assembly comprising:

(a) a wrench subassembly comprising:

(i) an upper wrench having a jaw assembly that is adapted to grip a pipe section or to release it;

(ii) a lower wrench having a jaw assembly that is adapted to grip a pipe section or to release it;

(iii) a bearing plate having a bearing hole;

wherein one of the upper wrench and the lower wrench is pivotally moveable with respect to the other to apply a twisting force to a pipe section gripped by one of the upper and lower wrenches with respect to an adjacent pipe section gripped by the other of the upper and lower wrenches;

(f) means for pivotally moving one of the upper wrench and the lower wrench with respect to the other;

(g) a generally planar support table having a pivot shaft;

(h) a spherical bearing that is placed over the pivot shaft and received in the bearing hole of the bearing plate (i) means for attaching the wrench subassembly to the support table, said means being adapted to allow the wrench subassembly to pivot about an axis that is perpendicular to the plane of the support table;

(j) means for attaching the wrench subassembly to the support table, said means being adapted to allow the wrench subassembly to tilt with respect to the plane of the support table.

* * * * *